US009052622B2

(12) United States Patent
Saito et al.

(10) Patent No.: US 9,052,622 B2
(45) **Date of Patent: *Jun. 9, 2015**

(54) ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS AND IMAGE FORMING METHOD

(75) Inventors: Yutaka Saito, Kanagawa (JP); Katsuyuki Kitajima, Kanagawa (JP); Masahiro Takagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 389 days.

This patent is subject to a terminal disclaimer.

(21) Appl. No.: 13/214,710

(22) Filed: Aug. 22, 2011

(65) Prior Publication Data

US 2012/0237864 A1 Sep. 20, 2012

(30) Foreign Application Priority Data

Mar. 14, 2011 (JP) ..... 2011-055609

(51) Int. Cl.
*G03G 9/08* (2006.01)
*G03G 9/097* (2006.01)

(52) U.S. Cl.
CPC ..... *G03G 9/0827* (2013.01); *G03G 9/09725* (2013.01)

(58) Field of Classification Search
CPC ..... G03G 9/09725; G03G 9/0827
USPC ..... 430/110.3, 108.7, 123.51; 399/252
See application file for complete search history.

(56) References Cited

U.S. PATENT DOCUMENTS

| | | | | |
|---|---|---|---|---|
| 5,422,218 | A | 6/1995 | Tong | |
| 5,837,414 | A | 11/1998 | Kitani et al. | |
| 6,077,635 | A | 6/2000 | Okado et al. | |
| 6,403,271 | B1 | 6/2002 | Suzuki et al. | |
| 7,163,773 | B2 * | 1/2007 | Sugiura et al. | 430/109.4 |
| 7,169,526 | B2 * | 1/2007 | Ishikawa et al. | 430/110.1 |
| 7,344,816 | B2 * | 3/2008 | Matsumura et al. | 430/124.31 |
| 7,611,815 | B2 * | 11/2009 | Sugiura et al. | 430/108.7 |
| 2002/0048473 | A1 | 4/2002 | Yamada et al. | |
| 2002/0061457 | A1 | 5/2002 | Okuno et al. | |
| 2002/0115008 | A1 | 8/2002 | Suzuki et al. | |
| 2003/0134217 | A1 | 7/2003 | Combes et al. | |
| 2003/0148203 | A1 | 8/2003 | Suzuki et al. | |
| 2003/0219667 | A1 | 11/2003 | Matsumoto et al. | |
| 2004/0067189 | A1 | 4/2004 | Sugiura et al. | |
| 2004/0197693 | A1 | 10/2004 | Ninomiya et al. | |
| 2005/0164109 | A1 | 7/2005 | Lizuka et al. | |
| 2006/0045571 | A1 * | 3/2006 | Matsuura et al. | 399/149 |
| 2006/0251979 | A1 | 11/2006 | Watanabe et al. | |
| 2007/0009823 | A1 | 1/2007 | Skorokhod et al. | |
| 2007/0042285 | A1 * | 2/2007 | Kitani et al. | 430/110.2 |
| 2007/0099105 | A1 | 5/2007 | Itoh | |
| 2007/0218387 | A1 | 9/2007 | Ishii et al. | |
| 2007/0274737 | A1 * | 11/2007 | Serizawa et al. | 399/106 |
| 2008/0014527 | A1 | 1/2008 | Kotsugai et al. | |
| 2008/0086951 | A1 | 4/2008 | Wakamiya et al. | |
| 2008/0096116 | A1 | 4/2008 | Utsumi et al. | |
| 2008/0268362 | A1 | 10/2008 | Kudo | |
| 2008/0286668 | A1 | 11/2008 | Ishigami et al. | |
| 2009/0042121 | A1 | 2/2009 | Toizumi et al. | |
| 2009/0123857 | A1 | 5/2009 | Shu et al. | |
| 2009/0196658 | A1 * | 8/2009 | Sugiura | 399/252 |
| 2010/0203443 | A1 | 8/2010 | Okita et al. | |
| 2010/0233607 | A1 | 9/2010 | Asano et al. | |
| 2010/0248110 | A1 | 9/2010 | Taguchi et al. | |
| 2011/0097659 | A1 * | 4/2011 | Sugiura et al. | 430/108.2 |
| 2011/0287355 | A1 | 11/2011 | Udo | |
| 2011/0318581 | A1 * | 12/2011 | Zenitani et al. | 428/402 |
| 2012/0156601 | A1 | 6/2012 | Kitajima et al. | |
| 2012/0231381 | A1 | 9/2012 | Kitajima et al. | |
| 2013/0071781 | A1 | 3/2013 | Saito et al. | |
| 2013/0108949 | A1 | 5/2013 | Kitajima et al. | |

FOREIGN PATENT DOCUMENTS

| | | |
|---|---|---|
| JP | A-6-266152 | 9/1994 |
| JP | A-9-319134 | 12/1997 |
| JP | A-11-174731 | 7/1999 |
| JP | A-2001-66820 | 3/2001 |
| JP | A-2002-108001 | 4/2002 |
| JP | A-2004-102236 | 4/2004 |
| JP | A-2004-295110 | 10/2004 |
| JP | A-2005-266557 | 9/2005 |
| JP | A-2006-251220 | 9/2006 |
| JP | A-2007-121882 | 5/2007 |
| JP | A-2007-199579 | 8/2007 |

(Continued)

OTHER PUBLICATIONS

Japaense Patent Office AIPN machine-assisted English-language translation of JP 2001-059261 (pub. Mar. 2011).*

U.S. Appl. No. 13/214,793, filed Aug. 22, 2011 in the name of Katsuyuki Kitajima et al.

Apr. 11, 2013 Office Action issued in U.S. Appl. No. 13/214,793.

U.S. Appl. No. 13/351,783, filed Jan. 17, 2012 in the name of Yutaka Saito et al.

U.S. Appl. No. 13/112,699, filed May 20, 2011 in the name of Katsuyuki Kitajima et al.

U.S. Appl. No. 13/432,918, filed Mar. 28, 2012 in the name of Katsuyuki Kitajima et al.

(Continued)

*Primary Examiner* — Janis L Dote
(74) *Attorney, Agent, or Firm* — Oliff PLC

(57) ABSTRACT

An electrostatic image developing toner including: a toner particle containing a coloring agent and a binder resin; and an external additive on the toner particle, wherein the external additive contains a silica particle, a primary particle of the silica particle has an average particle diameter of from 70 nm to 400 nm, a particle size distribution index of the primary particle of from 1.0 to 1.9, and an average circularity of from 0.5 to 0.9.

15 Claims, 2 Drawing Sheets

(56) References Cited

FOREIGN PATENT DOCUMENTS

| | | | | |
|---|---|---|---|---|
| JP | A-2008-129125 | | | 6/2008 |
| JP | A-2008-169102 | | | 7/2008 |
| JP | A-2009-78935 | | | 4/2009 |
| JP | A-2009-137791 | | | 6/2009 |
| JP | 2009-149493 | A | | 7/2009 |
| JP | A-2009-156978 | | | 7/2009 |
| JP | A-2010-243664 | | | 10/2010 |
| JP | 2001-059261 | A | * | 3/2011 |
| WO | WO 2006/070871 | | | 7/2006 |

OTHER PUBLICATIONS

Nov. 29, 2012 Office Action issued in Australian Patent Application No. 2012202495.
Mar. 14, 2013 Office Action issued in Australian Patent Application No. 2012202495.
Apr. 24, 2013 Office Action issued in U.S. Appl. No. 13/432,918.
May 31, 2013 Office Action issued in U.S. Appl. No. 13/351,783.
Nov. 21, 2012 Office Action issued in U.S. Appl. No. 13/112,699.
Feb. 1, 2013 Office Action issued in U.S. Appl. No. 13/351,783.
Jul. 26, 2013 Office Action issued in U.S. Appl. No. 13/112,699.
Aug. 7, 2013 Office Action issued in U.S. Appl. No. 13/214,793.
Aug. 14, 2013 Office Action issued in U.S. Appl. No. 13/432,918.
Sep. 20, 2013 Office Action issued in U.S. Appl. No. 13/351,783.
Nov. 21, 2013 Office Action issued in U.S. Appl. No. 13/112,699.
Feb. 13, 2014 Office Action issued in U.S. Appl. No. 13/351,783.
Apr. 28, 2014 Submission of Information cited in JP Application No. 2010-279757 (with English Translation).
Jun. 30, 2014 Office Action issued in U.S. Appl. No. 13/112,699.
Sep. 1, 2014 Notification issued in Japanese Patent Application No. 2011-055609 w/translation.
Sep. 22, 2014 Office Action issued in Korean Patent Application No. 10-2011-0105103 w/translation.
Nov. 11, 2014 Office Action issued in Japanese Patent Application No. 2011-055609 with English translation.
Machine-assisted English-language translation of JP 2010-224502 (pub. Oct. 2010).
Sep. 22, 2014 Office Action issued in Korean Application No. 10-2011-0105100 (including English Translation).
Mar. 12, 2015 Office Action issued in Korean Application No. 10-2011-0105100.

* cited by examiner

ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS AND IMAGE FORMING METHOD

CROSS-REFERENCE TO RELATED APPLICATION(S)

The present application claims priority from Japanese Patent Application No. 2011-055609 filed on Mar. 14, 2011, the entire content of which is incorporated herein by reference.

BACKGROUND

1. Field

The present invention relates to an electrostatic image developing toner, an electrostatic image developer, a toner cartridge, a process cartridge, an image forming apparatus and an image forming method.

2. Description of the Related Art

In the electrophotography, in general, an image is formed through plural steps including electrically forming a latent image on a photoreceptor (electrostatic latent image holding member) utilizing a photoconductive material by various means, developing the formed latent image with a developer containing a toner to form a developed image, transferring this developed image onto a transfer-receiving medium such as paper optionally via an intermediate transfer material, and then fixing this transferred image by heating, pressurizing, heating and pressurizing or the like.

In the image formed through such steps, there may be caused such a problem that the density of the fixed image changes, or a part of toner particles attaches in a non-image area, due to use of the toner over a long period of time.

SUMMARY (1) An electrostatic image developing toner including: a toner particle containing a coloring agent and a binder resin; and an external additive on the toner particle, wherein the external additive contains silica particles, primary particles of the silica particles have an average particle diameter of from 70 nm to 400 nm, a particle size distribution index of the primary particle of from 1.0 to 1.9, and an average circularity of from 0.5 to 0.9.

BRIEF DESCRIPTION OF DRAWINGS

Exemplary embodiments of the present invention will be described in detail based on the following figures, wherein.

DETAILED DESCRIPTION OF EXEMPLARY EMBODIMENTS

Figure 1:
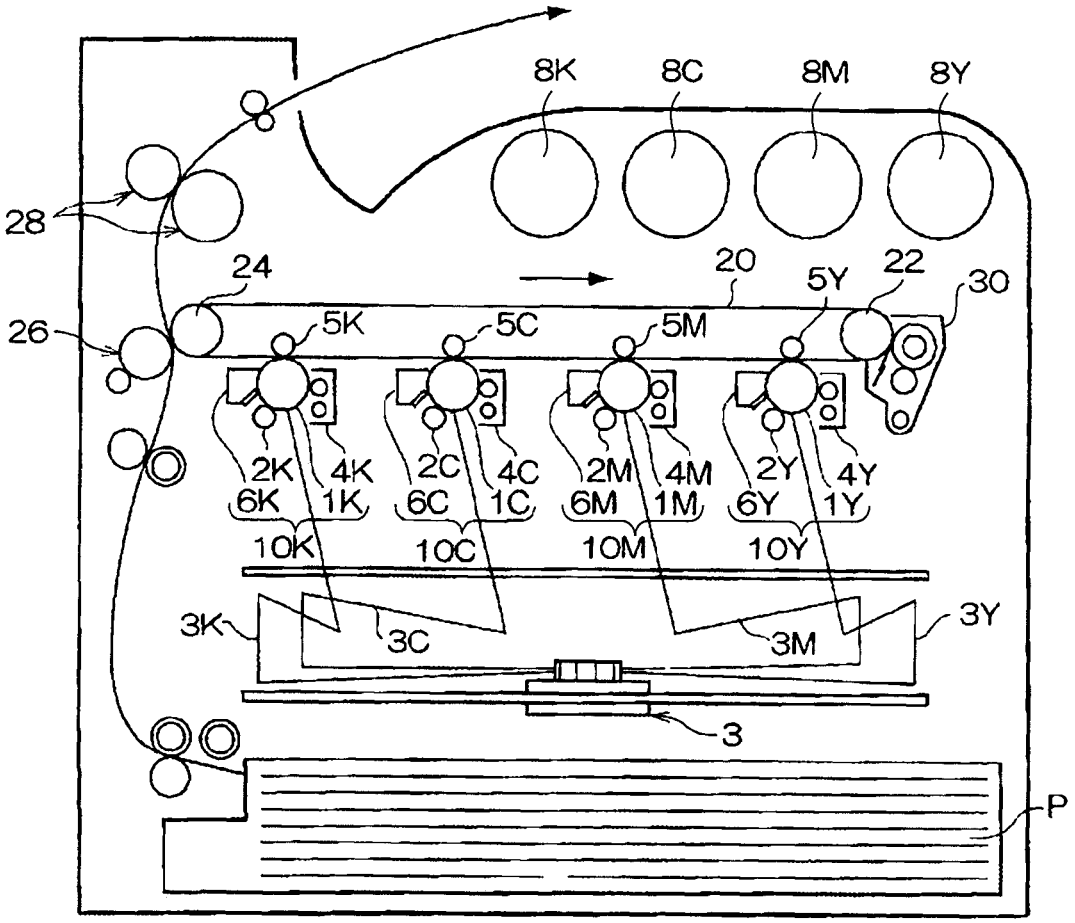
FIG. 1 is a diagrammatic configuration view showing an example of an image forming apparatus according to an exemplary embodiment of the invention.

Exemplary embodiments of the invention are hereunder described in detail,

<Electrostatic Image Developing Toner>

The electrostatic image developing toner according to the present exemplary embodiment (hereinafter also referred to simply as "toner") is constituted so as to include a toner particle containing at least a coloring agent and a binder resin; and silica particles externally added onto the surface of the toner particle, which have an average particle diameter of from 70 nm to 400 nm, a specific gravity of from 1.0 to 1.9 and an average circularity of from 0.5 to 0.9.

When the toner takes the foregoing constitution, uneven distribution of the silica particles on the surface of the toner particle is suppressed. While the reason for this is not elucidated yet, it may be considered that this is caused due to the following reason.

In general, silica particles obtained by a sol-gel method is a spherical particle having an average particle diameter of from 70 nm to 400 nm and a specific gravity of from 1.0 to 1.9 and also having an average circularity of more than 0.9. When such silica particles are used as an external additive of a toner particle, since its specific gravity is light, the silica particles are hardly embedded on the surface of the toner particle against a mechanical load which the toner receives within a developing machine, so that a lowering of image density to be caused due to a lowering of transfer properties of a toner image may be suppressed.

However, for example, when friction of the subject spherical silica particles with a carrier is caused therein, because of its small specific gravity and spherical form, the silica particles are easy to roll and move on the surface of the toner particle. For that reason, it may be considered that the silica particle is easily distributed unevenly in a concave of the toner particle, and the surface of the toner particle is exposed. In general, in view of the fact that the surface of the toner particle is constituted of components including a binder resin and has stickiness, the toner particles, the surfaces of which are exposed, are easy to adhere to and aggregate with each other. As a result, it may be considered that an image in which a color spot is generated (a phenomenon in which coloration is caused in a spotted form in a white paper part on the image forming surface) is formed.

It may be considered that uneven distribution of the silica particles in a concave of the toner particle is easily generated especially in the case where an output of low image density (low area coverage) at which a lowering of replacement properties of the toner is caused is continued. It may be considered that this is caused due to the fact that a relative existence ratio of the carrier increases, so that friction between the silica particles and the carrier becomes large.

Also, aggregation of the toner particles is easily caused especially in a high-temperature and high-humidity environment (for example, in an environment at 30° C. and 85% RH) in which the binder resin is easily sticky.

In consequence, as a result, there is brought a state where a color spot is easily generated in an environment which is a high-temperature and high-humidity environment and in which an output of a low image density is continued.

On the other hand, in the present exemplary embodiment, the circularity of the silica particle having the foregoing particle diameter and specific gravity is regulated to from 0.5 to 0.9. That is, by making the shape of the silica particle heterogeneous from a spherical shape to a heterogeneous shape, even in the case where friction between the silica particle and the carrier becomes large, a contact point and a contact area between the silica particle and the surface of the toner particle becomes large as compared with the case of a spherical silica particle. Therefore, it may be considered that the silica particle according to the present exemplary embodiment is hardly distributed unevenly in a concave of the toner particle. As a result, it may be considered that exposure of the surface of the toner particle is suppressed, and aggregation of the toner particles with each other is suppressed, so that the generation of a color spot on the image may be suppressed.

In particular, even in the case where an output of low image density (low area coverage) is continued in a high-temperature and high-humidity environment in which a color spot is easily generated, as described previously, uneven distribution of silica particles on the surface of the toner particle is suppressed. Therefore, it may be considered that exposure of the surface of the toner particle is suppressed, and aggregation of toner particles is suppressed, so that the generation of a color spot on the image may be suppressed.

Incidentally, in JP-A-11-174731, it is described that a silicon halide compound is subjected to vapor-phase oxidation, and at the vapor-phase oxidation, calcination is carried out at a temperature at which primary particles of silica coalesce, thereby producing a non-spherical silica powder. However, when the silica particle is calcined in this way, it may be considered that the specific gravity becomes larger than 1.9, so that the silica particle is easily embedded on the surface of the toner particle.

Each of the constitutions of the toner according to the present exemplary embodiment is hereunder described in detail.

First of all, the toner particle is described.

[Toner Particle]

The toner particle contains at least a binder resin and a coloring agent, and if desired, it may further contain a release agent and other internal additive.

Though the binder resin is not particularly limited, examples thereof include homopolymers made of a monomer such as styrenes (for example, styrene, p-chlorostyrene, α-methylstyrene, etc.), esters having a vinyl group (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.), vinyl nitriles (for example, acrylonitrile, methacrylonitrile, etc.), vinyl ethers (for example, vinyl methyl ether, vinyl isobutyl ether, etc.), vinyl ketones (for example, vinyl methyl ketone, vinyl ethyl ketone, vinyl isopropenyl ketone, etc.), and olefins (for example, ethylene, propylene, butadiene, etc.); copolymers obtained by combining two or more kinds thereof; and mixtures thereof. Also, examples of the binder resin further include non-vinyl condensed resins such as epoxy resins, polyester resins, polyurethane resins, polyamide resins, cellulose resins and polyether resins; mixtures of such a non-vinyl condensed resin and the foregoing vinyl resin; and graft polymers obtained by polymerizing a vinyl based monomer in the copresence of the foregoing material.

The styrene resins, (meth)acrylic resins or styrene (meth) acrylic copolymer resins are, for example, obtainable from a styrene based monomer or a (meth)acrylic acid based monomer solely or a proper combination thereof by a known method. Incidentally, the term "(meth)acrylic" is an expression including any of "acrylic" or "methacrylic".

The polyester resin is obtained by choosing and combining suitable components among dicarboxylic acid components and diol components and subjecting the combination to synthesis by adopting a conventionally known method, for example, an ester interchange method, a polycondensation method or the like.

In the case of using, as the binder resin, a styrene resin, a (meth)acrylic resin or a copolymer resin thereof, it is preferable to use a resin having a weight average molecular weight Mw in the range of from 20,000 to 100,000 and a number average molecular weight Mn in the range of from 2,000 to 30,000. Meanwhile, in the case of using, as the binder resin, a polyester resin, it is preferable to use a resin having a weight average molecular weight Mw in the range of from 5,000 to 40,000 and a number average molecular weight Mn in the range of from 2,000 to 10,000.

It is desirable that a glass transition temperature of the binder resin is in the range of from 40° C. to 80° C. When the glass transition temperature falls within the foregoing range, it is easy to keep a minimum fixing temperature.

The coloring agent is not particularly limited so far as it is a known color agent. Examples thereof include carbon blacks such as Furnace Black, Chanel Black, Acetylene Black and Thermal Black; inorganic pigments such as red iron oxide, ultramarine blue and titanium oxide; azo pigments such as Fast Yellow, Disazo Yellow, Pyrazolone Red, Chelate Resin, Brilliant Carmine and Para Brown; phthalocyanine pigments such as copper phthalocyanine and non-metal phthalocyanine; and condensed polycyclic pigments such as Flavanthrone Yellow, Dibromoanthrone Orange, Perylene Red, Quinacridone Red and Dioxazine Violet.

As to the coloring agent, if desired, a surface-treated coloring agent may be used. The coloring agent may also be used together with a dispersant. Also, plural kinds of coloring agents may be used jointly.

A content of the coloring agent is desirably from 1% by mass to 30% by mass relative to the total mass of the binder resin.

Examples of the release agent include hydrocarbon based waxes; natural waxes such as carnauba wax, rice wax and candelilla wax; synthetic or mineral or petroleum based waxes such as montan wax; and ester based waxes such as fatty acid esters and montanic acid esters. However, it should not be construed that the release agent is limited thereto.

From the viewpoint of storage stability, a melting temperature of the release agent is desirably 50° C. or higher, and more desirably 60° C. or higher. Also, from the viewpoint of offset resistance, the melting temperature of the release agent is desirably not higher than 110° C., and more desirably not higher than 100° C.

A content of the release agent is desirably from 1% by mass to 15% by mass, more desirably from 2% by mass to 12% by mass, and still more desirably from 3% by mass to 10% by mass.

Examples of other internal additive include a magnetic material, a charge controlling agent and an inorganic powder.

A shape factor SF1 of the toner particles is from 125 to 140 (desirably from 125 to 135, and more desirably from 130 to 135), and a shape factor SF2 of the toner particles is from 105 to 130 (desirably from 110 to 125, and more desirably from 115 to 120).

The shape factor SF1 is determined according to the following expression.

$$\text{Shape factor SF1}=(ML^2/A)\times(\pi/4)\times 100$$

In the foregoing expression, ML represents an absolute maximum length of the toner particle, and A represents a projected area of the toner particle, The shape factor SF1 may be obtained by mainly analyzing a microscopic image or a scanning electron microscopic (SEM) image using an image analyzer to express it numerically and, for example, calculating the numerical values in the following manner. That is, an optical microscopic image of toner particles spread on the surface of a slide glass is incorporated into a Luzex image analyzer through a video camera, the maximum length and projected area of 100 toner particles are determined, and an average value thereof is determined through calculation according to the foregoing expression.

The shape factor SF2 is determined in the following manner.

Toner particles are observed using a scanning electron microscope (for example, S-4100, manufactured by Hitachi, Ltd., etc.) to photograph an image; this image is incorporated into an image analyze (for example, LUZE III, manufactured by Nireco Corporation); with respect to each of 100 toner particles, SF2 is calculated on the basis of the following expression; and an average value thereof is determined, thereby defining it as the shape factor SF2. Incidentally, a magnification of the electron microscope is adjusted such that from about 3 to about 20 external additives come out in one field of view, and observations of plural fields of view are gathered, thereby calculating SF2 on the basis of the following expression.

$$\text{Shape factor SF2}=\{PM^2/(4\cdot A\cdot\pi)\}\times 100$$

In the foregoing expression, PM represents a circumferential length of the toner particle; A represents a projected area; and it represents the ratio of the circumferential of a circle to its diameter, A volume average particle diameter of the toner particles is desirably from 2 μm to 10 μm, and more desirably from 4 μm to 8 μm.

The measurement of the volume average particle diameter of the toner particles is performed at an aperture size of 50 μm by using COULTER MULTISIZER II particle size analyzer (manufactured by Beckman Coulter, Inc.). At that time, the measurement is performed after dispersing the toner particles in an electrolyte aqueous solution (ISOTON aqueous solution) and ultrasonically dispersing the solution for 30 seconds or more.

As the measurement method, a measurement sample in an amount ranging from 0.5 mg to 50 mg is added to 2 mL of a 5% by mass aqueous solution of, as a dispersant, a surfactant, desirably a sodium alkylbenzenesulfonate. This mixture is added to the electrolyte solution in an amount of from 100 mL to 150 mL. The electrolytic solution having this measurement sample suspended therein is subjected to a dispersion treatment for about one minute by using an ultrasonic disperser, thereby measuring a particle size distribution of particles. A number of particles to be measured is 50,000.

A cumulative distribution regarding the volume is drawn from the small diameter side with respect to the particle size range (channel) divided on the basis of the thus measured particle size distribution. A particle diameter at an accumulation of 50% is defined as the volume average particle diameter.

Next, the silica particle is described.

[Silica Particle]

The silica particle have an average particle diameter of from 70 nm to 400 nm, a specific gravity of from 1.0 to 1.9 and an average circularity of from 0.5 to 0.9.

—Average Particle Diameter—

When the average particle diameter of the silica particles is less than 70 nm, the shape of the particle is easy to become spherical, so that a shape having an average circularity of from 0.5 to 0.9 may not be achieved. Also, in the case where the silica particles are allowed to be externally added onto the surface of the toner particle, the silica particles are hardly dispersed on the surface of the toner particle. When the average particle diameter of the silica particles exceeds 400 nm, in the case where a mechanical load is applied to the silica particles, the silica particles are easily broken. Also, in the case where the silica particles are allowed to be externally added onto the surface of the toner particle, the strength of the toner (toner particle having the silica particles externally added thereto) is hardly enhanced, and the fluidity of the toner is hardly increased.

The average particle diameter of the silica particles is desirably from 100 nm to 350 nm, and more desirably from 100 nm to 250 nm.

The average particle diameter of the silica particles means a 50% diameter ($D_{50}$) in a cumulative frequency of circle-corresponding diameters obtained by observing 100 primary particles after dispersing the silica particles in the toner particle by an SEM (scanning electron microscope) apparatus and then performing an image analysis of the primary particles.

—Specific Gravity—

The silica particles have a specific gravity of from 1.0 to 1.9.

When the specific gravity of the silica particles exceed 1.9, when the silica particles receive a mechanical load, the silica particles are easily embedded on the surface of the toner particle, whereas when it is less than 1.0, the silica particles are easy to move, so that it is easily distributed unevenly in a concave of the toner particle.

The specific gravity of the silica particle is desirably from 1.1 to 1.8.

The specific gravity of the silica particles is measured in the following manner.

The specific gravity is measured using a Le Chatelier specific gravity bottle in conformity with 5-2-1 of JIS-K-0061: 92. The operation is carried out in the following manner.

(1) About 250 mL of ethyl alcohol is charged in a Le Chatelier specific gravity bottle and adjusted such that a meniscus thereof reaches the position of graduations.

(2) The specific gravity bottle is soaked in a constant-temperature water bath, and when a liquid temperature reaches 20.0±0.2° C., the position of the meniscus is accurately read out by the gradations of the specific gravity bottle (accuracy is regulated to 0.025 mL).

(3) About 100.000 g of a sample is weighed, and a mass thereof is defined as W.

(4) The weighed sample is charged in the specific gravity bottle, and bubbles are removed.

(5) The specific gravity bottle is soaked in a constant-temperature water bath, and when a liquid temperature reaches 20.0±0.2° C., the position of the meniscus is accurately read out by the gradations of the specific gravity bottle (accuracy is regulated to 0.025 mL).

(6) A specific gravity is calculated according to the following expressions.

$$D=W/(L2-L1) \quad \text{(A)}$$

$$S=D/0.9982 \quad \text{(B)}$$

In the foregoing expressions, D represents a density (g/cm$^3$) of the sample (at 20° C.); S represents a specific gravity (at 20° C.); W represents an apparent mass (g) of the sample; L1 is a reading (mL) of the meniscus before the sample is charged in the specific gravity bottle (at 20° C.); L2 is a reading (mL) of the meniscus after the sample is charged in the specific gravity bottle (at 20° C.); and 0.9982 is a density (g/cm$^3$) of water at 20° C.

Also, the specific gravity of the silica particle in a state where it is externally added to the toner particle is determined in the following manner.

The silica particles are subjected to mapping at an accelerating voltage of 20 kV using an energy dispersion type X-ray analyzer EMAX model 6923H (manufactured by Horiba, Ltd.) installed in an electron microscope S4100. A material species of the silica particles is conjectured from an elemental composition, and a true specific gravity of the conjectured material species is approximated by the specific gravity of the silica particles.

—Average Circularity—

The silica particles have an average circularity of from 0.5 to 0.9.

When the circularity of the silica particles exceed 0.9, since the silica particles are close to a sphere, on the occasion of allowing the silica particles to be externally added onto the surface of the toner particle, mixing properties or adhesion to the toner particle is poor, so that the resulting particle is easier to roll on the surface of the toner particle. For that reason, for example, in the case where friction thereof with a carrier is caused, or after storing the toner, the silica particles may be more likely distributed unevenly or may be desorbed from the toner particle. When the average circularity of the silica particles is less than 0.5, the resulting particle has a shape of a large aspect ratio, and in the case where a mechanical load is applied to the silica particles, stress concentration is caused, so that the resulting particle is easily broken. Incidentally, in the case of producing the silica particles by a sol-gel method, it is understood that it is difficult to produce silica particles in which primary particles thereof have an average circularity of less than 0.5.

The average circularity of the silica particles is desirably from 0.5 to 0.8.

Incidentally, the average circularity of the silica particles is obtained as "100/SF2" which is calculated according to the following expression by observing primary particles after dispersing the silica particles in the toner particle by an SEM apparatus and then performing an image analysis of the obtained primary particles.

$$\text{Circularity}(100/SF2)=4\pi\times(A/I^2)$$

In the foregoing expression, I represents a circumferential length of the primary particles of the silica particles on the image; A represents a projected area of the primary particles of the silica particles; and SF2 represents a shape factor.

The average circularity of the silica particles is obtained as a 50% circularity in a cumulative frequency of circularities of 100 primary particles obtained by the foregoing image analysis.

(Components and Surface Treatment)

The silica particles may be a particle composed mainly of silica, namely $SiO_2$ and may be either crystalline or amorphous. Also, the silica particles may be a particle produced using, as a raw material, a silicon compound such as water glass and an alkoxysilane, or may be a particle obtained by pulverizing quartz.

Also, from the viewpoint of dispersibility of the silica particles, it is preferable that the surface of the silica particles is subjected to a hydrophobic treatment. For example, the silica particles are hydrophobilized by bonding an alkyl group onto the surface of the silica particles. For that reason, for example, a known organosilicon compound having an alkyl group may be allowed to act on the silica particles. Details of a method of the hydrophobic treatment are described later.

An addition amount of the already-described silica particle having an average particle diameter of from 70 nm to 400 nm, a specific gravity of from 1.0 to 1.9 and an average circularity of from 0.5 to 0.9 (hereinafter also referred to as "specified silica particle") is preferably from 0.3% by mass to 15% by mass, and more preferably from 0.5% by mass to 10% by mass relative to a total weight of a toner particle.

A preparation method of the specified silica particles is not particularly limited so far as it is a method in which silica particles having an average particle diameter of from 70 nm to 400 nm, a specific gravity of from 1.0 to 1.9 and an average circularity of from 0.5 to 0.9 may be obtained. For example, the specified silica particles may be produced by a method of obtaining a silica sol using water glass as a raw material, or may be produced by a so-called wet method in which a particle is formed by a sol-gel method using, as a raw material, a silicon compound represented by an alkoxysilane.

However, according to a method by a dry method of producing silica particles by calcinating silica and then pulverizing and classifying it, in general, the specific gravity of the silica particles exceed 1.9, so that the specified silicas may not be produced from the standpoint of specific gravity. On the other hand, according to a method of forming a particle by a sol-gel method using, as a raw material, a silicon compound represented by an alkoxysilane, voids are formed in the silica particles, whereby silica particles having a specific gravity of from 1.0 to 1.9 and an average particle diameter of from 70 nm to 400 nm is easily obtainable.

Furthermore, since the specified silica particles are silica particles in a heterogeneous shape having an average circularity of not more than 0.9, in order to produce a toner having the specified silica particles having such a shape on the surface of the toner particle, it is desirable to adopt a preparation method of silica particles having the following steps.

The preparation method of silica particles according to the present exemplary embodiment includes a step of preparing an alkaline catalyst solution containing an alkaline catalyst in a concentration of from 0.6 mol/L to 0.85 mol/L in an alcohol-containing solvent (also referred to as an "alkaline catalyst solution preparing step"); and a step of supplying a tetraalkoxysilane in a supply amount of from 0.002 mol/(mol·min) to 0.009 mol/(mol·min) relative to the alcohol into the alkaline catalyst solution and also supplying an alkaline catalyst in an amount of from 0.1 mol to 0.4 mol per mole of the total supply amount of the tetraalkoxysilane to be supplied per minute to obtain silica particles (specified silica particles) (also referred to as a "silica particle forming step").

Namely, in the preparation method of silica particles according to the present exemplary embodiment, a tetraalkoxysilane that is a raw material and separately, an alkaline catalyst that is a catalyst are supplied, respectively in the foregoing relations in the presence of an alcohol containing an alkaline catalyst in the foregoing concentration, thereby allowing the tetraalkoxysilane to react. There is thus formed the specified silica particles.

In the preparation method of silica particles according to the present exemplary embodiment, the specified silica particles in a heterogeneous shape having an average particle diameter of from 70 nm to 400 nm, a specific gravity of from 1.0 to 1.9 and an average circularity of from 0.5 to 0.9 is obtained by the foregoing technique. While a reason for this is not elucidated yet, it may be considered that this is caused due to the following reason.

First of all, when the alkaline catalyst solution containing the alkaline catalyst is prepared in the alcohol-containing solvent, and the tetraalkoxysilane and the alkaline catalyst are supplied, respectively in this solution, the tetraalkoxysilane supplied in the alkaline catalyst solution reacts to form a nucleus particle. At that time, when the alkaline catalyst concentration in the alkaline catalyst solution falls within the foregoing range, it may be considered that a nucleus article in heterogeneous shape is formed while suppressing the formation of a coarse aggregate such as a secondary aggregate. It may be considered that this is caused due to the fact that though in addition to the catalytic action, the alkaline catalyst has an action to coordinate to the surface of the nucleus particle to be formed, thereby contributing to the shape and dispersion stability of the nucleus particle, when its amount falls within the foregoing range, the alkaline catalyst does not uniformly coat the surface of the nucleus particle (namely, the alkaline catalyst is unevenly distributed and attaches onto the surface of the nucleus particle), and therefore, while the dispersion stability of the nucleus particle is kept, partial deviations in surface tension and chemical affinity of the nucleus particle are caused, so that the nucleus particle in heterogeneous shape is formed.

Here, it may be considered that the supply amount of the tetraalkoxysilane is related to the particle size distribution or the circularity of the silica particles. It may be considered that by regulating the supply amount of the tetraalkoxysilane to from 0.002 mol/(mol·min) to 0.009 mol/(mol·min), before a contact probability between the tetraalkoxysilane and the nucleus particle at a particle growth stage is increased, and the tetraalkoxysilane is supplied into the nucleus particle without a deviation, a reaction between the tetraalkoxysilane and the nucleus particle may be caused. Namely, it may be considered that the reaction between the tetraalkoxysilane and the nucleus particle is deviated. For that reason, it may be considered that the deviation of the supply of the tetraalkoxysilane into the nucleus particle is accelerated, thereby bringing scattering of the particle growth.

Incidentally, it may be considered that the average particle diameter of the silica particles is dependent upon the total supply amount of the tetraalkoxysilane.

In light of the above, in the preparation method of a silica particle according to the present exemplary embodiment, it may be considered that the specified silica particles in a heterogeneous shape, which are small in the formation of a coarse aggregate and which have an average particle diameter of from 70 nm to 400 nm, a specific gravity of from 1.0 to 1.9 and an average circularity of from 0.5 to 0.9, is obtained.

By allowing the specified silica particles obtained by the foregoing method to attach onto the surface of the toner particle, the toner according to the present exemplary embodiment in which uneven distribution of the silica particles on the toner particle are suppressed may be produced.

Also, in the alkaline catalyst solution preparing step and the silica particle forming step (the both steps will be also generally called a "specified silica particle producing step") in the preparation method of silica particles according to the present exemplary embodiment, it may be considered that a nucleus particle in a heterogeneous shape is formed, and the nucleus particle is allowed to grow while keeping this heterogeneous shape, thereby forming silica particles. Therefore, it may be considered that silica particles in a heterogeneous shape having high shape stability against a mechanical load are obtained.

Also, in the specified silica particle producing step, it may be considered that the particle is allowed to grow in a state where the formed nucleus particle in a heterogeneous shape keeps its heterogeneous shape, whereby the silica particle is obtained. Therefore, it may be considered that silica particles which are strong against a mechanical load and are hardly broken are obtained.

Also, in the present preparation method of the specified silica particles, in view of the fact that the particle formation is performed by supplying each of the tetraalkoxysilane and the alkaline catalyst into the alkaline catalyst solution and causing a reaction of the tetraalkoxysilane, as compared with the case of producing silica particles in a heterogeneous shape by a mere sol-gel method, a total amount of the used alkaline catalyst is small, and as result, an omission of a removal step of the alkaline catalyst is realized. This is advantageous especially in the case where silica particles are applied to products in which a high purity is required.

—Alkaline Catalyst Solution Preparing Step—

First of all, the alkaline catalyst solution preparing step is described.

In the alkaline catalyst solution preparing step, an alcohol-containing solvent is prepared, to which is then added an alkaline catalyst to prepare an alkaline catalyst solution.

The alcohol-containing solvent may be a solvent composed of an alcohol solely, or may be a mixed solvent of an alcohol with other solvent such as water; ketones (for example, acetone, methyl ethyl ketone, methyl isobutyl ketone, etc.); cellosolves (for example, methyl cellosolve, ethyl cellosolve, butyl cellosolve, cellosolve acetate, etc.); and ethers (for example, dioxane, tetrahydrofuran, etc.), if desired.

In the case of a mixed solvent, it would be better that an amount of the alcohol relative to other solvent is 80% by mass or more (desirably 90% by mass or more).

Incidentally, examples of the alcohol include lower alcohols such as methanol and ethanol.

Meanwhile, the alkaline catalyst is a catalyst for accelerating the reaction (for example, a hydrolysis reaction or a condensation reaction) of the tetraalkoxysilane, and examples thereof include basic catalysts such as ammonia, urea, a monoamine and a quaternary ammonium salt. Of these, ammonia is especially desirable.

A concentration (content) of the alkaline catalyst is from 0.6 mol/L to 0.85 mol/L, desirably from 0.63 mol/L to 0.78 mol/L, and more desirably from 0.66 mol/L to 0.75 mol/L.

When the concentration of the alkaline catalyst is less than 0.6 mol/L, dispersibility of a formed nucleus particle in a growth process of the nucleus particle becomes instable, so that there is a concern that a coarse aggregate such as a secondary aggregate is formed, or gelation occurs, thereby deteriorating the particle size distribution.

On the other hand, when the concentration of the alkaline catalyst is more than 0.85 mol/L, stability of a formed nucleus particle becomes excessive, a nucleus particle in a true spherical shape is formed, and it is difficult to obtain a nucleus particle in a heterogeneous shape having an average circularity of not more than 0.85. As a result, it is difficult to obtain the specified silica particle in heterogeneous shape.

Incidentally, the concentration of the alkaline catalyst is a concentration relative to the alkaline catalyst solution (the alkaline catalyst+the alcohol-containing solvent).

—Silica Particle Forming Step—

Next, the silica particle forming step is described.

The silica particle forming step is a step of supplying each of a tetraalkoxysilane and an alkaline catalyst into the alkaline catalyst solution to subject the tetraalkoxysilane to a reaction (for example, a hydrolysis reaction or a condensation reaction) in the alkaline catalyst solution, thereby forming silica particles.

In this particle forming step, at the beginning of supply of the tetraalkoxysilane, a nucleus particle is formed by the reaction of the tetraalkoxysilane (nuclear particle forming stage), and thereafter, the silica particles are formed through growth of this nucleus particle (nucleus particle growing stage).

Examples of the tetraalkoxysilane which is supplied into the alkaline catalyst solution include tetramethoxysilane, tetraethoxysilane, tetrapropoxysilane and tetrabutoxysilane. However, from the standpoints of controllability of the reaction rate, the shape, particle diameter and particle size distribution of the obtained silica particles, and the like, tetramethoxysilane or tetraethoxysilane is desirable.

A supply amount of the tetraalkoxysilane is from 0.002 mol/(mol·min) to 0.009 mol/(mol·min) relative to the alcohol in the alkaline catalyst solution.

This means that the tetraalkoxysilane is supplied in a supply amount of from 0.002 mol to 0.009 mol per minute relative to one mole of the alcohol used in the step of preparing an alkaline catalyst solution.

By allowing the supply amount of the tetraalkoxysilane to fall within the foregoing range, silica particles in a heterogeneous shape having an average circularity of from 0.5 to 0.9 is easily formed in a high proportion (for example, 95% by number or more).

Incidentally, though the particle diameter of the silica particles varies with the kind of the tetraalkoxysilane or the reaction condition, primary particles having a particle diameter of 100 nm or more is obtained by regulating a total supply amount of the tetraalkoxysilane used for the reaction of particle formation to, for example, 1.08 mol or more per liter of the silica particle dispersion liquid, and primary particles having a particle diameter of not more than 500 nm are obtained by regulating a total supply amount of the tetraalkoxysilane used for the reaction of particle formation to, for example, not more than 5.49 mol or more per liter of the silica particle dispersion liquid.

When the supply amount of the tetraalkoxysilane is less than 0.002 mol/(mol·min), a contact probability between the tetraalkoxysilane added dropwise and the nucleus particle is more decreased. However, it takes a long period of time for completion of the dropwise addition of the total supply amount of the tetraalkoxysilane, and the preparation efficiency is poor.

When the supply amount of the tetraalkoxysilane is more than 0.009 mol/(mol·min), the supply amount of the tetraalkoxysilane becomes excessive relative to the reaction of tetraalkoxysilanes with each other at a nucleus particle forming stage, or the reaction between the tetraalkoxysilane and the nucleus particle in the particle growth, so that the reaction system is easily gelled, thereby impairing the nucleus particle formation and the particle growth.

The supply amount of the tetraalkoxysilane is desirably from 0.002 mol/(mol·min) to 0.0085 mol/(mol·min), and more desirably from 0.002 mol/(mol·min) to 0.0080 mol/(mol·min).

Meanwhile, examples of the alkaline catalyst which is supplied into the alkaline catalyst solution include those exemplified above. Though this alkaline catalyst to be supplied may be the same as or different from the alkaline catalyst previously contained in the alkaline catalyst solution, it would be better to use the alkaline catalyst of the same kind.

A supply amount of the alkaline catalyst is from 0.1 mol to 0.4 mol, desirably from 0.14 mol to 0.35 mol, and more desirably from 0.18 mol to 0.30 mol per mole of the total supply amount of the tetraalkoxysilane to be supplied per minute.

When the supply amount of the alkaline catalyst is less than 0.1 mol per mole of the total supply amount of the tetraalkoxysilane to be supplied per minute, dispersibility of a formed nucleus particle in a growth process of the formed nucleus particle becomes instable, so that there may be the case where a coarse aggregate such as a secondary aggregate is formed, or gelation occurs, thereby deteriorating the particle size distribution.

On the other hand, when the supply amount of the alkaline catalyst is more than 0.4 mol, stability of a formed nucleus particle becomes excessive, and there may be the case where even when a nucleus particle in heterogeneous shape is formed at a nucleus particle forming stage, the nucleus particle grows in a spherical shape at its nucleus particle growth stage, so that a silica particle in heterogeneous shape is not obtained.

Here, in the silica particle forming step, each of the tetraalkoxysilane and the alkaline catalyst is supplied into the alkaline catalyst solution. The supply method may be a mode of continuously supplying them, or a mode of intermittently supplying them.

Also, in the silica particle forming step, a temperature in the alkaline catalyst solution (temperature at the time of supply) may be, for example, in the range of from 5° C. to 50° C. and is desirably in the range of from 15° C. to 40° C.

The specified silica particles are obtained through the foregoing steps. Though the specified silica particles obtained in this state are obtained in a state of a dispersion liquid, it may be used as a silica particle dispersion liquid as it is, or may be taken out and used as a powder of the silica particle after removing the solvent.

In the case of using the silica particles as a silica particle dispersion liquid, a solids concentration of the silica particle may be adjusted upon being diluted with water or an alcohol or being concentrated, if desired. Also, the silica particle dispersion liquid may be used upon being subjected to solvent substitution with a water-soluble organic solvent such as other alcohol, an ester and a ketone.

When the silica particles are used as a powder, it is required that a solvent from the silica particle dispersion is removed. Examples of a method of removing the solvent of the silica particle dispersion liquid include known methods such as (1) a method of performing drying using a vacuum dryer, a tray type dryer, etc. after removing the solvent by means of filtration, centrifugation, distillation or the like; and (2) a method of directly drying the slurry using a fluidized layer dryer, a spray dryer or the like. Though a drying temperature is not particularly limited, it is desirably not higher than 200° C. When the drying temperature is higher than 200° C., bonding among primary particles to each other or generation of a coarse particle due to condensation of a silanol group remaining on the surface of the silica particles is easy to occur.

It would be better that if desired, the dried silica particles are crushed and sieved, thereby removing a coarse particle or aggregate. Though a crushing method is not particularly limited, it is, for example, performed by a dry type pulverizer such as a jet mill, a vibration mill, a ball mill and a pin mill. A sieving method is, for example, performed using a known device such as a vibration sieve and a wind force sieve.

The specified silica particles obtained by the specified silica particle producing step may be used after subjecting the surface of the specified silica particles to a hydrophobic treatment with a hydrophobic treatment agent.

Examples of the hydrophobic treatment agent include known organosilicon compounds having an alkyl group (for example, a methyl group, an ethyl group, a propyl group, a butyl group, etc.). Specific examples thereof include silazane compounds (for example, hexamethyldisilazane, tetramethyldisilazane, etc.) and silane compounds (for example, methyltrimethoxysilane, dimethyldimethoxysilane, trimethylchlorosilane, trimethylmethoxysilane, etc.). The hydrophobic treatment agent may be used solely or in combination of plural kinds thereof.

Of these hydrophobic treatment agents, organosilicon compounds having a trimethyl structure, such as trimethylmethoxysilane and hexamethyldisilazane, are suitable.

Though a use amount of the hydrophobic treatment agent is not particularly limited, in order to obtain a hydrophobic effect, it is, for example, from 1% by mass to 100% by mass, and desirably from 5% by mass to 80% by mass relative to the specific silica particle.

Examples of a method of obtaining a hydrophobic silica particle dispersion liquid having been subjected to a hydrophobic treatment with a hydrophobic treatment agent include a method of obtaining a hydrophobic silica particle dispersion liquid by adding a necessary amount of a hydrophobic treatment agent to a specified silica particle dispersion liquid and allowing the mixture to react with stirring at a temperature ranging from 30° C. to 80° C., thereby subjecting the specified silica particles to a hydrophobic treatment. When this reaction temperature is a lower temperature than 30° C., the hydrophobic reaction hardly proceeds, whereas when the reaction temperature is a temperature exceeding 80° C., there may be the case where gelation of the dispersion liquid by self-condensation of the hydrophobic treatment agent or aggregation among silica particles to each other is easy to occur.

Meanwhile, examples of a method of obtaining a powdered hydrophobic silica particle include a method in which a hydrophobic silica particle dispersion liquid is obtained by the foregoing method and then dried by the foregoing method, thereby obtaining a powder of a hydrophobic silica particles; a method in which a silica particle dispersion liquid is dried to obtain a powder of a hydrophilic silica particles, which are then subjected to a hydrophobic treatment by the addition of a hydrophobic treatment agent, thereby obtaining a powder of a hydrophobic silica powder; and a method in which after obtaining a hydrophobic silica particle dispersion liquid, the hydrophobic silica particle dispersion liquid is dried to obtain a powder of a hydrophobic silica particle, which is further subjected to a hydrophobic treatment by the addition of a hydrophobic treatment agent, thereby obtaining a powder of a hydrophobic silica particles.

Here, examples of a method of subjecting powdered specific silica particles to a hydrophobic treatment include a method in which a powdered hydrophilic silica particles are stirred within a treatment tank such as a HENSCHEL mixer and a fluidized bed, a hydrophobic treatment agent is added thereto, and the inside of the treatment tank is heated to gasify the hydrophobic treatment agent, thereby allowing it to react with a silanol group on the surface of the powdered specified silica particle. Though a treatment temperature is not particularly limited, it may be, for example, from 80° C. to 300° C., and it is desirably from 120° C. to 200° C.

Other external additive than the specified silica particle may be allowed to attach to the toner particle.

Examples of other external additive than the specified silica particles include inorganic particles such as alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Also, resin particles such as fluorocarbon resins and silicone resins and metal salts of a higher fatty acid represented by zinc stearate may be used.

An addition amount of other external additive than the specified silica particle may be from 0.3% by mass to 3.0% by mass relative to the total mass of the toner particle.

Next, the preparation method of a toner according to the present exemplary embodiment is described.

The toner according to the present exemplary embodiment is obtained by after producing a toner particle, externally adding the specified silica particle as an external additive to the toner particle.

Though as the preparation method of a toner particle, there are exemplified a kneading and pulverization method and a wet granulation method, it is desirable to produce the toner particle by a wet granulation method. Examples of the wet granulation method include known methods such as a melt suspension method, an emulsion aggregation/coalescence method and a dissolution suspension method.

As a method of externally adding the external additive to the obtained toner particle, there is exemplified a method of achieving mixing by a known mixer, for example, a V-type blender, a HENSCHEL mixer, or a LOEDIGE mixer.

<Electrostatic Image Developer>

The electrostatic image developer according to the present exemplary embodiment is one containing at least the toner according to the present exemplary embodiment.

The electrostatic image developer according to the present exemplary embodiment may be a single-component developer containing only the toner according to the present exemplary embodiment, or may be a two-component developer containing a mixture of the subject toner and a carrier.

The carrier is not particularly limited, and known carriers are exemplified. Examples of the carrier include a resin-coated carrier, a magnetic-dispersed carrier and a resin-dispersed carrier.

In the two-component developer, a mixing ratio (mass ratio) of the toner according to the present exemplary embodiment and the carrier is desirably in the range of from about 1/100 to about 30/100, and more desirably in the range of from about 3/100 to about 20/1000 in terms of a ratio of the toner to the carrier.

<Image Forming Apparatus and Image Forming Method>

Next, the image forming apparatus and the image forming method according to the present exemplary embodiment, each of which uses the toner according to the present exemplary embodiment, are described.

The image forming apparatus according to the present exemplary embodiment includes an electrostatic latent image holding member; a charging unit for charging the surface of the latent image holding member; an electrostatic latent image forming unit for forming an electrostatic latent image on the surface of the electrostatic latent image holding member; a developing unit accommodating the electrostatic image developer according to the present exemplary embodiment therein, which develops the electrostatic latent image formed on the surface of the electrostatic latent image holding member with the developer to form a toner image; a transfer unit for transferring the toner image onto a recording medium; and a fixing unit for fixing the toner image on the recording medium.

In accordance with the image forming apparatus according to the present exemplary embodiment, there is carried out an image forming method including a charging step of charging the surface of an electrostatic latent image holding member; an electrostatic latent image forming step of forming an electrostatic latent image on the surface of the charged electrostatic latent image holding member; a developing step of developing the electrostatic latent image formed on the surface of the electrostatic latent image holding member with the electrostatic image developer according to the present exemplary embodiment to form a toner image; a transfer step of transferring the toner image onto a recording medium; and a fixing step of fixing the toner image on the recording medium.

In the case of utilizing an electrophotographic photoreceptor as the electrostatic latent image holding member, the formation of an image in the image forming apparatus according to the present exemplary embodiment is, for example, carried out in the following manner. First of all, the surface of the electrophotographic photoreceptor is charged by a corotron charger, a contact charger or the like and then exposed to form an electrostatic latent image. Subsequently, the electrostatic latent image is allowed to attach to a toner upon being brought into contact with or made close to a developing roller having a developer layer formed on the surface thereof, thereby forming a toner image on the electrophotographic photoreceptor. The formed toner image is transferred onto the surface of a recording medium such as paper by utilizing a corotron charger or the like. Furthermore, the toner image transferred onto the surface of the recording medium is fixed by a fixing device, thereby forming an image on the recording medium.

Incidentally, in the image forming apparatus according to the present exemplary embodiment, for example, a portion including the developing unit may be of a cartridge structure (for example, a toner cartridge, a process cartridge, etc.) which is mounted detachably against the image forming apparatus.

As the toner cartridge, for example, a toner cartridge accommodating the electrostatic image developing toner according to the present exemplary embodiment therein, which is mounted detachably against the image forming apparatus, is suitably useful.

As the process cartridge, for example, a process cartridge accommodating the electrostatic image developer according to the present exemplary embodiment therein, which is provided with a developing unit for developing an electrostatic latent image formed on the surface of the electrostatic latent image holding member with the electrostatic image developer to form a toner image and which is mounted detachably against the image forming apparatus, is suitably useful.

An example of the image forming apparatus according to the present exemplary embodiment is hereunder described, but it should not be construed that the invention is limited thereto. Incidentally, major parts shown in the drawings are described, and the description of other parts is omitted.

FIG. 1 is a diagrammatic configuration view showing an image forming apparatus of a quadruplet tandem mode, which is an example of the image forming apparatus according to the present exemplary embodiment. The image forming apparatus shown in FIG. 1 is provided with first to fourth electrophotographic image forming units 10Y, 10M, 10C and 10K, which output yellow (Y), magenta (M), cyan (C) and black (K) color images, respectively on the basis of color-separated image data. These image forming units (hereinafter also referred to simply as "unit" or "units") 10Y, 10M, 10C and 10K are arranged horizontally in a line with predetermined distances therebetween. Incidentally, each of these units 10Y, 10M, 10C and 10K may be a process cartridge which is mounted detachably against the image forming apparatus main body.

An intermediate transfer belt 20 is provided as an intermediate transfer member extending above each of the units 10Y, 10M, 10C and 10K as shown in the drawings. The intermediate transfer belt 20 is provided around a drive roller 22 and a support roller 24 coming into contact with the inner surface of the intermediate transfer belt 20, which are separated from left to right as shown in the drawings. The intermediate transfer belt 20 runs in a direction from the first unit 10Y to the fourth unit 10K. Incidentally, the support roller 24 is biased in a direction of separation from the drive roller 22 by a spring or the like (not shown), such that a predetermined tension is applied to the intermediate transfer belt 20 which is provided around the support roller 24 and the drive roller 22. Also, on the surface of the image holding member side of the intermediate transfer belt 20, an intermediate transfer member cleaning device 30 is provided opposing to the drive roller 22.

Also, toners in the four colors of yellow, magenta, cyan and black, which are stored in toner cartridges 8Y, 8M, 8C and 8K, respectively, are supplied to developing devices (developing units) 4Y, 4M, 4C and 4K of the units 10Y, 10M, 10C and 10K, respectively.

Each of the foregoing first to fourth units 10Y, 10M, 10C and 10K has the same configuration. Therefore, the first unit 10Y which forms a yellow image and is provided on the upstream side in a running direction of the intermediate transfer belt 20 is representatively described herein. The components in the second to fourth units 10M, 10C and 10K are designated by letters M for magenta, C for cyan and K for black, respectively in the same manner in which the equivalent components in the first unit 10Y are indicated by Y for yellow, and the description thereof is omitted.

The first unit 10Y includes a photoreceptor 1Y functioning as a latent image holding member. In the surroundings of the photoreceptor 1Y, there are successively disposed a charge roller 2Y for charging the surface of the photoreceptor 1Y to a predetermined potential; an exposing device 3 for exposing the charged surface with a laser beam 3Y on the basis of a color-separated image signal to form an electrostatic latent image; the developing device (developing unit) 4Y for supplying a charged toner into an electrostatic latent image to develop the electrostatic latent image; a primary transfer roller 5Y (primary transfer unit) for transferring the developed toner image onto the intermediate transfer belt 20; and a photoreceptor cleaning device (cleaning unit) 6Y for removing the toner remaining on the surface of the photoreceptor 1Y after the primary transfer.

Incidentally, the primary transfer roller 5Y is disposed in the inside of the intermediate transfer belt 20 and provided at a position opposing to the photoreceptor 1Y. Furthermore, each of the primary transfer rollers 5Y, 5M, 5C and 5K is connected to a bias power source (not shown) for impressing a primary transfer bias to each of the primary transfer rollers. Each of the bias power sources is controlled by a control section (not shown) such that a transfer bias to be impressed to each of the primary transfer rollers may be changed.

An operation of forming a yellow image in the first unit 10Y is hereunder described. First of all, prior to the operation, the surface of the photoreceptor 1Y is charged to from about −600 V to about −800 V by the charge roller 2Y The photoreceptor 1Y is formed by laminating a photosensitive layer on a conductive substrate (volume resistivity at 20° C.: not more than $1\times10^{-6}$ Ωcm). Though in general, this photosensitive layer has high resistance (resistance as in general resins), it has such characteristics that when irradiated with the laser beam 3Y, a specific resistance of a portion irradiated with the laser beam changes. Then, the laser beam 3Y is outputted onto the surface of the charged photoreceptor 1Y via the exposing device 3 according to image data for yellow sent from the control section (not shown). The laser beam 3Y is irradiated on the photosensitive layer on the surface of the photoreceptor 1Y, whereby an electrostatic image having a yellow printing pattern is formed on the surface of the photoreceptor 1Y.

The electrostatic image as referred to herein is an image formed on the surface of the photoreceptor 1Y by charging and is a so-called negative latent image which is formed by the matter that the specific resistance of an irradiated portion of the photosensitive layer is lowered due to the laser beam 3Y, and a charge charged on the surface of the photoreceptor 1Y is discharged, whereas a charge in a portion not irradiated with the laser beam 3Y remains.

The electrostatic image thus formed on the photoreceptor 1Y is rotated to a predetermined developing position following running of the photoreceptor 1Y. Then, the electrostatic image on the photoreceptor 1Y is made into a visible image (toner image) by the developing device 4Y at this developing position.

The developing device 4Y accommodates, for example, an electrostatic image developer according to the present exemplary embodiment, which stores at least a yellow toner and a carrier.

The developing device 4Y stores the yellow toner according to the present exemplary embodiment. The yellow toner undergoes frictional charging upon being stirred within the developing device 4Y, has a charge with the same polarity (negative polarity) as that of a charge charged on the photoreceptor 1Y and is retained on a developer roller (developer holding member). When the surface of the photoreceptor 1Y passes through the developing device 4Y, the yellow toner electrostatically attaches to a latent image portion at which the charge is removed from the surface of the photoreceptor 1Y, and the latent image is developed with the yellow toner. The photoreceptor 1Y on which a yellow toner image is formed is subsequently made to run at a predetermined speed, and the toner image developed on the photoreceptor 1Y is conveyed to a predetermined primary transfer position.

When the yellow toner image on the photoreceptor 1Y is conveyed to the primary transfer position, a predetermined primary transfer bias is impressed to the primary transfer roller 5Y, a static electricity force directed from the photoreceptor 1Y toward the primary transfer roller 5Y acts upon the toner image, and the toner image on the photoreceptor 1Y is transferred onto the intermediate transfer belt 20. At that time, the transfer bias to be impressed has a (positive) polarity opposite to that of the toner (having a negative polarity). For example, the first unit 10Y is controlled to about +10 μA by the control section (not shown).

Meanwhile, the toner remaining on the photoreceptor 1Y is removed by the cleaning device 6Y and recovered.

Also, primary transfer biases to be impressed respectively to the primary transfer roller 5M at the second unit 10M and thereafter, the primary transfer rollers 5C and 5K are controlled similarly to the primary transfer bias of the first unit.

In this way, the intermediate transfer belt 20 having a yellow toner image transferred thereonto from the first unit 10Y is successively conveyed through the second to fourth units 10M, 10C and 10K, and toner images of respective colors are superposed and multi-transferred.

The intermediate transfer belt 20 having the four toner images multi-transferred thereonto through the first to fourth units arrives at a secondary transfer portion which is constituted of the intermediate transfer belt 20, the support roller 24 coming into contact with the inner surface of the intermediate transfer belt 20 and a secondary transfer roller (secondary transfer unit) 26 disposed on the side of the image holding surface of the intermediate transfer belt 20. Meanwhile, a recording paper (transfer-receiving material) P is supplied at a predetermined timing through a supply mechanism to a gap at which the secondary transfer roller 26 and the intermediate transfer belt 20 are brought into press contact with each other, and a predetermined secondary transfer bias is impressed to the support roller 24. At that time, the transfer bias to be impressed has a (negative) polarity identical to that of the toner (also having a negative polarity), and a static electricity force directed from the intermediate transfer belt 20 toward the recording paper P acts upon the toner image, whereby the toner image on the intermediate transfer belt 20 is transferred onto the recording paper P. Incidentally, on that occasion, the secondary transfer bias is determined depending upon a resistance detected by a resistance detecting unit (not shown) for detecting a resistance of the secondary transfer portion, and its voltage is controlled.

Thereafter, the recording paper P is sent to a press contact part (nip part) of a pair of fixing rollers in a fixing device (fixing unit in a roller form) 28, and the toner image is heated, whereby the toner image having colors superposed thereon is melted and fixed onto the recording paper P.

Examples of the transfer-receiving material onto which the toner image is transferred include plain papers and OHP sheets used for copiers of an electrophotographic system, printers and so on.

In order to more enhance smoothness of the image surface after fixing, it is preferable that the surface of the transfer-receiving material is also smooth as far as possible. For example, coated papers obtained by coating the surface of plain paper with a resin or the like, art papers for printing and the like are suitably useful.

The recording paper P in which fixing of a color image is completed is conveyed toward an ejection portion, whereby a series of the color image formation operations ends.

Incidentally, the above-exemplified image forming apparatus has such a configuration that a toner image is transferred onto the recording paper P via the intermediate transfer belt 20. However, it should not be construed that the invention is limited to this configuration, and the invention may also have a structure in which a toner image is transferred directly from the photoreceptor to the recording paper.

<Process Cartridge and Toner Cartridge>

Figure 2:
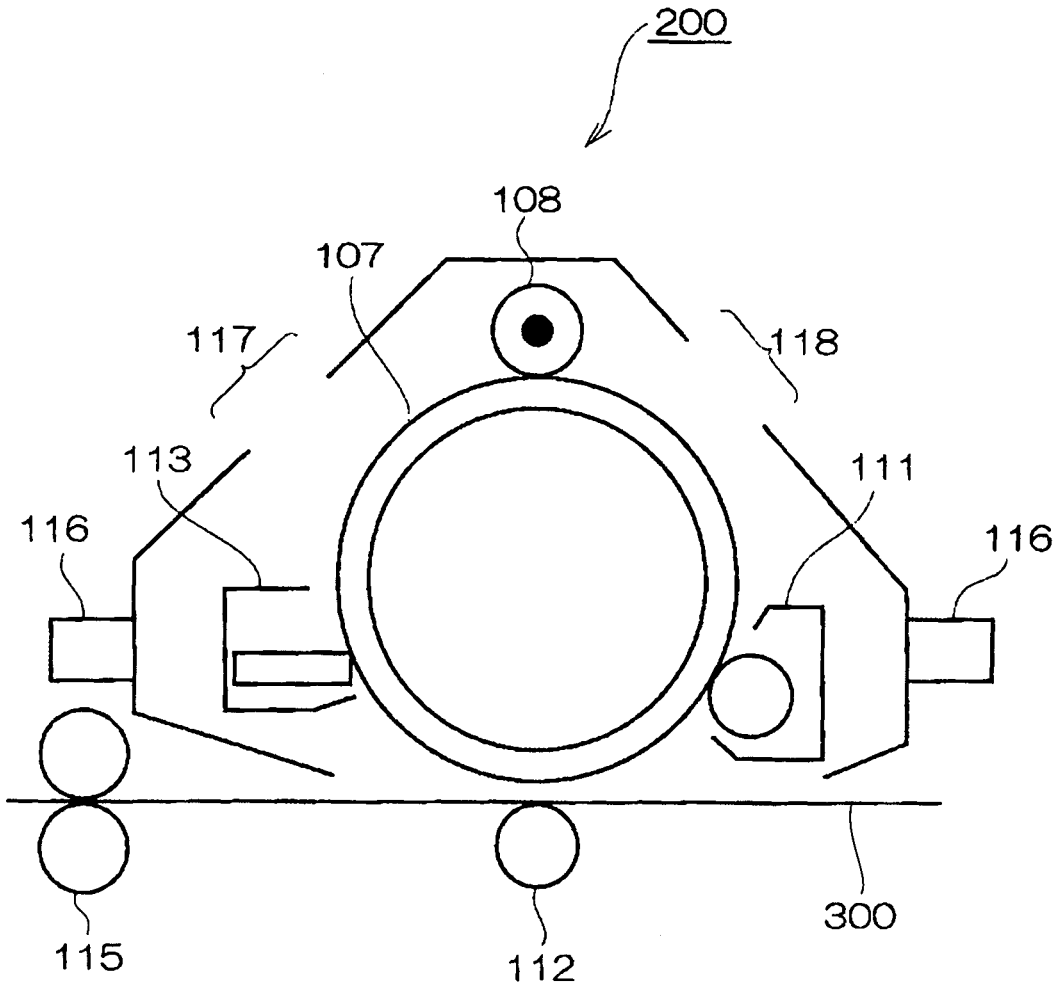
FIG. 2 is a diagrammatic configuration view showing an example of a process cartridge according to an exemplary embodiment of the invention.

FIG. 2 is a diagrammatic configuration view showing a suitable example of a process cartridge for storing the electrostatic image developer according to the present exemplary embodiment. A process cartridge 200 includes, integrally, a charge roller 108, a developing device 111, a photoreceptor cleaning device 113, an opening portion 118 for exposure and an opening portion 117 for charge removal exposure, together with a photoreceptor 107, all of which are combined using a mounting rail 116. Incidentally, in FIG. 2, a reference numeral 300 stands for a transfer-receiving material.

Then, this process cartridge 200 is mounted freely detachably against an image forming apparatus constituted of a transfer device 112, a fixing device 115 and other constituent portions (not shown).

The process cartridge 200 shown in FIG. 2 is provided with the charge roller 108, the developing device 111, the cleaning device 113, the opening portion 118 for exposure and the opening portion 117 for charge removal exposure; however, these devices may be selectively combined. The process cartridge according to the present exemplary embodiment is provided with, in addition to the photoreceptor 107, at least one member selected from the group consisting of the charge roller 108, the developing device 111, the cleaning device (cleaning unit) 113, the opening portion 118 for exposure and the opening portion 117 for charge removal exposure.

Next, the toner cartridge according to the present exemplary embodiment is described. The toner cartridge according to the present exemplary embodiment is a toner cartridge accommodating an electrostatic image developing toner therein, which is mounted detachably against the image forming apparatus. It is preferable that the electrostatic image developing toner of the invention is accommodated in 90 vol % or more relative to a volume of the toner cartridge.

Incidentally, the image forming apparatus shown in FIG. 1 is an image forming apparatus having a configuration in which the toner cartridges 8Y, 8M, 8C and 8K are mounted detachably, and the developing devices 4Y, 4M, 4C, and 4K are connected to toner cartridges corresponding to the respective developing devices (colors) via a toner supply line (not shown). Also, in the case where the toner stored in the toner cartridge runs low, the toner cartridge is exchanged.

EXAMPLES

The present exemplary embodiments are more specifically described below with reference to the following Examples, but it should be construed that the present exemplary embodiments are not in any way limited to these Examples. Incidentally, in the following description, all "parts" and "percentages" are "parts by mass" and "% by mass", respectively unless otherwise indicated.

Example 1

<Preparation of Toner>

[Preparation of Toner Particle]

(Preparation of Polyester Resin Dispersion Liquid)

Ethylene glycol [manufactured by Wako Pure Chemical Industries, Ltd.]: 37 parts

Neopentyl glycol [manufactured by Wako Pure Chemical Industries, Ltd.]: 65 parts 1,9-Nonanediol [manufactured by Wako Pure Chemical Industries, Ltd.]: 32 parts Terephthalic acid [manufactured by Wako Pure Chemical Industries, Ltd.]: 96 parts The foregoing monomers are put in a flask; the temperature is elevated to 200° C. over one hour; and after it is confirmed that the inside of the reaction system is uniformly stirred, 1.2 parts of dibutyltin oxide is added thereto. Furthermore, the temperature is elevated from the foregoing temperature to 240° C. over 6 hours while distilling off formed water, and a dehydration condensation reaction is further continued at 240° C. for 4 hours, thereby obtaining a polyester resin having an acid value of 9.4 mg-KOH/g, a weight average molecular weight of 13,000 and a glass transition temperature of 62° C.

Subsequently, this polyester resin in a molten state is transferred into a CAVITRON CD 1010 (manufactured by Eurotec, Ltd.) at a rate of 100 g per minute. Dilute ammonia water having a concentration of 0.37% by mass, which is obtained by diluting reagent ammonia water with ion-exchanged water, is put in a separately prepared aqueous medium tank and transferred into the foregoing CAVITRON at a rate of 0.1 L per minute while heating at 120° C. by a heat exchanger simultaneously with the foregoing molten polyester resin. The CAVITRON is operated under a condition at a rotation speed of a rotator of 60 Hz and at a pressure of 5 kg/cm$^2$.

There is thus obtained an amorphous polyester resin dispersion liquid having a resin particle having an average particle diameter of 160 nm, a solids content of 30%, a glass transition temperature of 62° C. and a weight average molecular weight Mw of 13,000 dispersed therein.

(Preparation of Coloring Agent Dispersion Liquid)

Cyan pigment [C.I.Pigment Blue 15:3, manufactured by Dainichiseika Color & Chemicals Mfg. Co., Ltd.]: 10 parts Anionic surfactant [NEOGEN SC, manufactured by Dai-ichi Kogyo Seiyaku Co., Ltd.]: 2 parts Ion-exchanged water: 80 parts The foregoing components are mixed and dispersed by a high-pressure counter collision disperser, ULTIMAIZER (HJP30006, manufactured by Sugino Machine Limited) for one hour, thereby obtaining a coloring agent dispersion liquid having a volume average particle diameter of 180 nm and a solids content of 20%.

(Preparation of Release Agent Dispersion Liquid)

Paraffin wax [HNP 9, manufactured by Nippon Seiro Co., Ltd.]: 50 parts

Anionic surfactant [NEOGEN SC, manufactured Dai-ichi Kogyo Seiyaku Co., Ltd.]: 2 parts Ion-exchanged water: 200 parts The foregoing components are heated at 120° C., and the resulting mixture is thoroughly mixed and dispersed using IKA's ULTRA-TURRAX T50 homogenizer. Thereafter, the resulting dispersion is subjected to a dispersion treatment using a pressure discharge type homogenizer, thereby obtaining a release agent dispersion liquid having a volume average particle diameter of 200 nm and a solids content of 20%.

(Preparation of Toner Particle (I))

Polyester resin dispersion liquid: 200 parts

Coloring agent dispersion liquid: 25 parts

Polyaluminum chloride: 0.4 parts

Ion-exchanged water: 100 parts

The foregoing components are put in a stainless steel-made flask and thoroughly mixed and dispersed using IKA's ULTRA-TURRAX homogenizer. Thereafter, the resulting dispersion is heated to 48° C. on an oil bath for heating while stirring the flask. After keeping at 48° C. for 30 minutes, 70 parts of the same polyester resin dispersion liquid as that described above is gently added.

Thereafter, after the pH within the system is adjusted to 8.0 using a sodium hydroxide aqueous solution having a concentration of 0.5 mol/L, the stainless steel-made flask is hermetically sealed, a seal of the stirring axis is magnetically sealed, and the solution is heated to 90° C. while continuing stirring, followed by keeping for 3 hours. After completion of the reaction, the reaction mixture is cooled at a temperature dropping rate of 2° C./min, filtered and then thoroughly washed with ion-exchanged water, followed by solid-liquid separation by means of Nutsche type suction filtration. This is further redispersed in 3 L of ion-exchanged water at 30° C. and stirred and washed at 300 rpm for 15 minutes. This operation is further repeated six times, and when the filtrate has a pH of 7.54 and an electric conductivity of 6.5 μS/cm, solid-liquid separation is performed using a No. 5A filter paper by means of Nutsche type suction filtration. Subsequently, vacuum drying is continued for 12 hours, thereby obtaining a toner particle (1).

As a result of measuring a volume average particle diameter $D_{50v}$ of the toner particle (1) by COULTER MULTISIZER II particle size analyzer, it is found to be 5.8 μm, with an SF1 being 130.

[Preparation of External Additive]

(Preparation of Silica Particle)

—Alkaline Catalyst Solution Preparing Step [Preparation of Alkaline Catalyst Solution (1)]—

In a glass-made reaction vessel having a volume of 3 L and equipped with a stirring blade, a dropping nozzle and a thermometer, 600 parts of methanol and 90 parts of 10% ammonia water are put and mixed with stirring to obtain an alkaline catalyst solution (1). At that time, an ammonia catalyst amount, i.e., an $NH_3$ amount in the alkaline catalyst solution (1) ($NH_3$ [mol]/(ammonia+methanol) [L]) is 0.62 mol/L.

—Particle Forming Step [Preparation of Silica Particle Suspension (1)]—

Subsequently, a temperature of the alkaline catalyst solution (1) is adjusted to 45° C., and the alkaline catalyst solution (1) is substituted with nitrogen. Thereafter, dropwise addition of 300 parts of tetramethoxysilane (TMOS) and 120 parts of ammonia water having a catalyst ($NH_3$) concentration of 4.44% in the following supply amounts is simultaneously started while stirring the alkaline catalyst solution (1) at 120 rpm, and the dropwise addition is performed over 20 minutes, thereby obtaining a suspension of the silica particle (silica particle suspension (1)).

Here, the supply amount of tetramethoxysilane (TMOS) is set to 15 g/min, namely 0.0053 mol/(mol·min) relative to a total molar number of methanol in the alkaline catalyst solution (1). Also, the supply amount of the 4.44% ammonia water is set to 6.0 g/min relative to a total supply amount of the tetraalkoxysilane to be supplied per minute. This is corresponding to 0.159 mol/min per mole of the total supply amount of the tetraalkoxysilane to be supplied per minute.

Thereafter, 250 g of the solvent of the resulting silica particle suspension (1) is distilled off by means of heat distillation, and 250 g of pure water is added. Thereafter, the resultant is dried by a freeze dryer, thereby obtaining a hydrophilic silica particle (1) in a heterogeneous shape.

—Hydrophobic Treatment of Silica Particle—

Furthermore, 20 g of methoxytrimethylsilane is added to 100 g of the hydrophilic silica particle (1), and the mixture is allowed to react at 150° C. for 2 hours, thereby obtaining a hydrophobic silica particle [silica particle (1)] in a heterogeneous shape in which the surface of silica is subjected to a hydrophobic treatment.

—Physical Properties of Silica Particle—

The resulting hydrophobic silica particle (1) is added to the toner particle (1), and 100 primary particles of the silica particle (1) are subjected to SEM photography. Subsequently, the resulting SEM photograph is subjected to image analysis. As a result, the primary particle of the silica particle (1) is found to be a heterogeneous particle having an average particle diameter ($D_{50v}$) of 150 nm and an average circularity [100/SF2] of 0.55.

Also, a specific gravity of the silica particle (1) is measured by a method in conformity with 5-2-1 of JIS-K-0061:92 as described previously.

The physical properties of the silica particle (1) are also shown in Table 1.

—Preparation of Toner—

0.4 g of the silica particle (1) is added to 20 g of the resulting toner particle (1) and mixed in a 0.4-L sample mill at 15,000 rpm for 30 seconds, thereby obtaining a toner (1) having the hydrophobic silica particle (1) attached thereto.

<Evaluation>

The resulting toner (1) and a carrier are charged in a V-type blended in a proportion of the toner (1) to the carrier of 5/95 (mass ratio), and the mixture is stirred for 20 minutes, thereby obtaining a developer (1).

Incidentally, the carrier as used herein is one prepared in the following manner.

—Carrier—

1,000 parts of Mn—Mg ferrite (volume average particle diameter: 50 μm, shape factor SF1: 120, manufactured by Powdertech Co., Ltd.) is put in a kneader; a solution prepared by dissolving 150 parts of a perfluorooctylmethyl acrylate-methyl methacrylate copolymer (polymerization ratio: 20/80, Tg: 72° C., weight average molecular weight: 72,000, manufactured by Soken Chemical & Engineering Co., Ltd.) in 700 parts of toluene is added; after mixing at ordinary temperature for 20 minutes, the mixture is dried under reduced pressure upon heating at 70° C.; and the dried material is taken out to obtain a coated carrier. Furthermore, the resulting coated carrier is sieved by a mesh having an opening of 75 μm to remove a coarse powder, thereby obtaining a carrier. A shape factor SF1 of the carrier is found to be 122.

The resulting developer (1) is filled in a developing machine of an image forming apparatus, DOCUCENTRE COLOR 400 MODIFIED (manufactured by Fuji Xerox Co., Ltd.) and evaluated with respect to a color spot. The results are shown in Table 1.

—Evaluation of Color Spot—

For the evaluation of color spot, 10,000 sheets of image with an area coverage of 20% are outputted under a high-temperature and high-humidity condition (at 30° C. and 85% RH), and thereafter, 100 sheets of full image with an area coverage of 100% are outputted, thereby counting a number of sheets in which a color spot is generated in the image area.

Examples 2 to 8 and Comparative Examples 1 to 5

Toners (2) to (8) of Examples 2 to 8 and toners (101) to (105) of Comparative Examples 1 to 5 are produced in the same manner as in the preparation of the toner (1), except that the silica particle (1) to be externally added to the toner particle (1) is changed to silica particles (2) to (8) and silica particles (101) to (105), respectively.

The resulting silica particles (2) to (8) and silica particles (101) to (105) are examined with respect to physical properties of silica particle in the same manner as in the silica particle (1).

Average particle diameter ($D_{50v}$), circularity [100/SF2] and specific gravity of each of the primary particles obtained by means of image analysis are shown in the columns of "Physical properties" of "Silica particle" in Table 1.

Also, developers (2) to (8) and developers (101) to (105) are produced in the same manner as in the preparation of the developer (1), except that the toners (2) to (8) and the toners (101) to (105) are used, respectively in place of the toner (1).

The evaluation of color spot is performed in the same manner as in Example 1, except for using the developers (2) to (8) and the developers (101) to (105), respectively.

The silica particles (2) to (8) and the silica particles (101) to (105) used in Examples 2 to 8 and Comparative Examples 1 to 5, respectively are produced in the following manner.

First of all, a preparation method of each of the silica particles (2) to (8) and the silica particles (103) to (105) is described.

Preparation of Silica Particles (2) to (8) and Silica Particles (103) to (105)—

Alkaline catalyst solutions (2) to (8) and alkaline catalyst solutions (103) to (105) are prepared in the same manner as in the preparation of the alkaline catalyst solution (1), except that "600 g" of methanol is changed to an amount shown in the column of "Mass (g)" of "Methanol" of "Components to be added" in Table 1; and that "90 g" of 10% ammonia water is changed to an amount shown in the column of "Mass (g)" of "10% ammonia water" of "Components to be added" in Table 1.

The catalyst amount "$NH_3$ amount" of each of the alkaline catalyst solutions (2) to (8) and the alkaline catalyst solutions (103) to (105) after the preparation is shown in the column of "$NH_3$ amount [mol/L]" of "10% ammonia water" of "Components to be added" in Table 1.

Subsequently, silica particle suspensions (2) to (8) and silica particle suspensions (103) to (105) are prepared in the same manner as in the preparation of the silica particle suspension (1), except that the alkaline catalyst solutions (2) to (8) and the alkaline catalyst solutions (103) to (105) are used, respectively in place of the alkaline catalyst solution (1); and that the amount and supply amount of tetramethoxysilane to be added in the alkaline catalyst solution and the catalyst concentration, amount and supply amount of ammonia water to be added to the alkaline catalyst solution are changed to amounts shown in Table 1, respectively.

Specifically, with respect to the amount and supply amount of tetramethoxysilane to be added in the alkaline catalyst solution, the amount of "300 g" of tetramethoxysilane is changed to an amount shown in the column of "Mass (g)" of "TMOS" of "Total addition amount" in Table 1; and the supply amount of "15 g/min" of tetramethoxysilane is changed to an amount in the column of "TMOS" of "Supply amount [g/min]" in Table 1.

With respect to the catalyst amount, amount and supply amount of ammonia water to be added in the alkaline catalyst solution, "4.44%" of the catalyst concentration of ammonia water is changed to an amount shown in the column of "$NH_3$ concentration IN" of "Ammonia water" of "Total addition amount" in Table 1; "120 g" of the amount of ammonia water is changed to an amount shown in the column of "Mass [g]" of "Ammonia water" of "Total addition amount" in Table 1; and "6 g/min" of the supply amount of ammonia water is changed to an amount shown in the column "Ammonia water" of "Supply amount [g/min]" in Table 1.

Here, the amount that is the supply amount of the ammonia catalyst into each of the alkaline catalyst solutions (2) to (8) and the alkaline catalyst solutions (103) to (105) and which is an amount per mole of the total supply amount of the tetraalkoxysilane to be supplied per minute is shown in the column of "$NH_3$ amount [mole/min] (vs. TMOS)" of "Supply amount (relative amount)" in Table 1.

Also, the amount that is the supply amount of the tetraalkoxysilane (TMOS) into each of the alkaline catalyst solutions (2) to (8) and the alkaline catalyst solutions (103) to (105) and which is an amount per mole of methanol in each of the alkaline catalyst solutions (2) to (8) and the alkaline catalyst solutions (103) to (105) is shown in the column of "TMOS amount [mole/(mole·min)] (vs. methanol)" of "Supply amount (relative amount)" in Table 1.

With respect to each of the resulting silica particle suspensions (2) to (8) and silica particle suspensions (103) to (105), the solvent is distilled off, and the residue is dried in the same manner as in the silica particle suspension (1), thereby obtaining hydrophilic silica particles (2) to (8) and hydrophilic silica particles (103) to (105).

Furthermore, each of the hydrophilic silica particles (2) to (8) and the hydrophilic silica particle (103) to (105) is subjected to a hydrophobic treatment in the same manner as in Example 1, thereby obtaining hydrophobic silica particles (2) to (8) and hydrophobic silica particles (103) to (105).

—Preparation of Silica Particle (101)—

100 g of a commercially available silica particle, AEROSIL #50 (manufactured by Nippon Aerosil Co., Ltd.) is classified using an air classifier, thereby producing a silica particle (101).

—Preparation of Silica Particle (102)—

100 g of a commercially available silica particle, TG-C122 (manufactured by Cabot Corporation) is classified using an air classifier, thereby obtaining a silica particle (102).

TABLE 1

| | Silica particle producing step | | | | | | |
|---|---|---|---|---|---|---|---|
| | Preparing step | | | Particle forming step | | | |
| | Components to be added | | | Supply | Total addition amount | | |
| | | 10% ammonia water | | temperature of | | Ammonia water | |
| | Methanol Mass [g] | Mass [g] | $NH_3$ amount [mol/L] | alkaline catalyst (° C.) | TMOS Mass [g] | Mass [g] | $NH_3$ amount [mol/L] |
| Ex. 1 | 600 | 90 | 0.62 | 45 | 300 | 120 | 4.44 |
| Ex. 2 | 600 | 90 | 0.62 | 25 | 300 | 120 | 4.44 |
| Ex. 3 | 600 | 95 | 0.65 | 45 | 300 | 180 | 4.44 |
| Ex. 4 | 600 | 95 | 0.65 | 25 | 300 | 180 | 4.44 |
| Ex. 5 | 600 | 90 | 0.62 | 45 | 540 | 250 | 4.44 |
| Ex. 6 | 600 | 90 | 0.62 | 25 | 540 | 250 | 4.44 |
| Ex. 7 | 600 | 95 | 0.65 | 45 | 490 | 350 | 4.44 |
| Ex. 8 | 600 | 95 | 0.65 | 25 | 490 | 350 | 4.44 |
| Comp. Ex. 1 | Silica is obtained by other method. | | | | | | |
| Comp. Ex. 2 | Silica is obtained by other method. | | | | | | |
| Comp. Ex. 3 | 500 | 120 | 0.94 | 45 | 280 | 200 | 4.44 |
| Comp. Ex. 4 | 500 | 120 | 0.94 | 25 | 280 | 200 | 4.44 |
| Comp. Ex. 5 | 600 | 90 | 0.62 | 25 | 150 | 60 | 4.44 |

| | Silica particle producing step Particle forming step | | | | Silica particle | | | | Evaluation |
|---|---|---|---|---|---|---|---|---|---|
| | Supply amount [g/min] | | Supply amount (relative amount) | | | Physical properties | | | Number of sheets of generation of color spot |
| | | | $NH_3$ amount | TMOS amount | | | | Particle | |
| | TMOS | Ammonia water | [mol/min] (vs. TMOS) | [mol/(mol · min)] (vs. methanol) | No. | Circularity | Specific gravity | diameter $D_{50v}$ [nm] | |
| Ex. 1 | 15 | 6 | 0.159 | 0.0053 | 1 | 0.55 | 1.9 | 150 | 0 |
| Ex. 2 | 15 | 6 | 0.159 | 0.0053 | 2 | 0.55 | 1.25 | 150 | 0 |
| Ex. 3 | 15 | 9 | 0.238 | 0.0053 | 3 | 0.78 | 1.9 | 150 | 2 |
| Ex. 4 | 15 | 9 | 0.238 | 0.0053 | 4 | 0.78 | 1.25 | 150 | 3 |
| Ex. 5 | 9 | 5 | 0.184 | 0.0032 | 5 | 0.67 | 1.9 | 360 | 3 |
| Ex. 6 | 9 | 5 | 0.184 | 0.0032 | 6 | 0.67 | 1.25 | 360 | 5 |
| Ex. 7 | 7 | 5 | 0.283 | 0.0025 | 7 | 0.86 | 1.9 | 360 | 8 |
| Ex. 8 | 7 | 5 | 0.283 | 0.0025 | 8 | 0.86 | 1.25 | 360 | 10 |

TABLE 1-continued

| | | | | | | | | | |
|---|---|---|---|---|---|---|---|---|---|
| Comp. Ex. 1 | | Silica is obtained by other method. | | | 101 | 0.55 | 2.2 | 150 | 30 |
| Comp. Ex. 2 | | Silica is obtained by other method. | | | 102 | 0.95 | 2.2 | 130 | 36 |
| Comp. Ex. 3 | 7 | 5 | 0.283 | 0.0029 | 103 | 0.95 | 1.25 | 140 | 40 |
| Comp. Ex. 4 | 7 | 5 | 0.283 | 0.0029 | 104 | 0.95 | 1.9 | 14 | 52 |
| Comp. Ex. 5 | 15 | 6 | 0.143 | 0.0053 | 105 | 0.48 | 1.25 | 80 | 35 |

From the foregoing results, in comparison with the Comparative Examples, according to the working Examples, even when after an image output with a low image density in a high-temperature and high-humidity environment is continued (10,000 sheets), an image is outputted, a color spot is hardly generated.

While the present invention has been shown and described with reference to certain exemplary embodiments thereof, it will be understood by those skilled in the art that various changes modifications may be made therein without departing from the spirit and scope of the present invention as defined by the appended claims.

What is claimed is:

1. An electrostatic image developing toner comprising:

a toner particle containing a coloring agent and a binder resin; and an external additive on the toner particle, wherein the external additive contains silica particles, primary particles of the silica particles have an average particle diameter of from 100 nm to 350 nm, a specific gravity of from 1.0 to 1.9, and an average circularity of from 0.5 to 0.9, and a shape factor SF2 of the toner particle is from 105 to 130.

2. The electrostatic image developing toner according to claim 1, wherein the primary particles of the silica particles have an average circularity of from 0.5 to 0.8.

3. The electrostatic image developing toner according to claim 1, wherein a shape factor SF1 of the toner particle is from 125 to 140.

4. The electrostatic image developing toner according to claim 1, wherein the silica particles have a specific gravity of from 1.1 to 1.8.

5. An electrostatic image developer comprising:

the electrostatic image developing toner according to claim 1; and a carrier.

6. The electrostatic image developer according to claim 5, wherein the primary particles of the silica particles have an average circularity of from 0.5 to 0,8.

7. The electrostatic image developer according to claim 5, wherein a shape factor SF1 of the toner particle is from 125 to 140.

8. A toner cartridge comprising the electrostatic image developing toner according to claim 1 therein, wherein the toner cartridge is detachably mounted against an image forming apparatus.

9. A process cartridge, comprising a developing unit for developing an electrostatic latent image formed on the surface of a latent image holding member with the electrostatic image developer to form a toner image, the developing unit comprising the electrostatic image developer according to claim 5 therein.

10. An image forming apparatus comprising:

an electrostatic latent image holding member;

a charging unit for charging the surface of the electrostatic latent image holding member;

an electrostatic latent image forming unit that forms an electrostatic latent image on the surface of the electrostatic latent image holding member;

a developing unit comprising the electrostatic image developer according to claim 5, which develops the electrostatic latent image formed on the surface of the electrostatic latent image holding member with the electrostatic image developer to form a toner image;

a transfer unit that transfers the toner image onto a recording medium; and a fixing unit that fixes the toner image on the recording medium.

11. The image forming apparatus according to claim 10, wherein the primary particles of the silica particles have an average circularity of from 0.5 to 0.8.

12. The image forming apparatus according to claim 10, wherein a shape factor SF1 of the toner particle is from 125 to 140.

13. An image forming method comprising:

charging the surface of an electrostatic latent image holding member;

forming an electrostatic latent image on the surface of the charged electrostatic latent image holding member;

developing the electrostatic latent image formed on the surface of the electrostatic latent image holding member with the electrostatic image developer according to claim 5 to form a toner image;

transferring the toner image onto a recording medium; and fixing the toner image on the recording medium.

14. The image forming method according to claim 13, wherein the primary particles of the silica particles have an average circularity of from 0.5 to 0.8.

15. The image forming method according to claim 13, wherein a shape factor SF1 of the toner particle is from 125 to 140.

* * * * *